United States Patent [19]

Naumoff et al.

[11] Patent Number: 4,727,461

[45] Date of Patent: Feb. 23, 1988

[54] COLLAPSIBLE LAMP SHADE

[75] Inventors: Charles P. Naumoff; Dennis R. Blumire, both of Greensburg, Pa.

[73] Assignee: Hamilton Corporation, Chicago, Ill.

[21] Appl. No.: 927,122

[22] Filed: Nov. 5, 1986

[51] Int. Cl.[4] ..... F21V 1/06

[52] U.S. Cl. ..... 362/352; 362/357; 362/361

[58] Field of Search ..... 362/351, 352, 355, 356, 362/357, 358, 360, 361

[56] References Cited

U.S. PATENT DOCUMENTS 4,383,291 5/1983 Gall ..... 362/356

4,625,268 11/1986 Payne ..... 362/357

*Primary Examiner*—Samuel Scott

*Assistant Examiner*—Noah Kamen

*Attorney, Agent, or Firm*—Epstein & Edell

[57] ABSTRACT

A collapsible lamp shade includes a pair of resiliently compressible channel-defining members projecting inwardly from the interior surface of the shade cover to engage the periphery of a shade frame in a channel having an opening which is wider than the frame thickness. A structurally independent arcuately biased wire is selectively threaded into a sleeve at the lower edge of the cover to rigidify and radially expand the lower edge. Expansion of the lower edge tends to contract the upper edge about the frame to effect a more positive engagement of the frame in the channel. Structural independency of the frame engagement and the threaded rigidifying wire permit simple assembly at each edge of the shade without dislodging assembled components at the other edge. In the preferred embodiment the upper edge channel is defined by a cloth strip secured to the interior surface of the cover and having two transversely spaced sleeves extending in respective annular paths. Each sleeve contains a resiliently compressible length of material, such as twine, defining respective ribs which are resiliently compressible during assembly.

52 Claims, 21 Drawing Figures

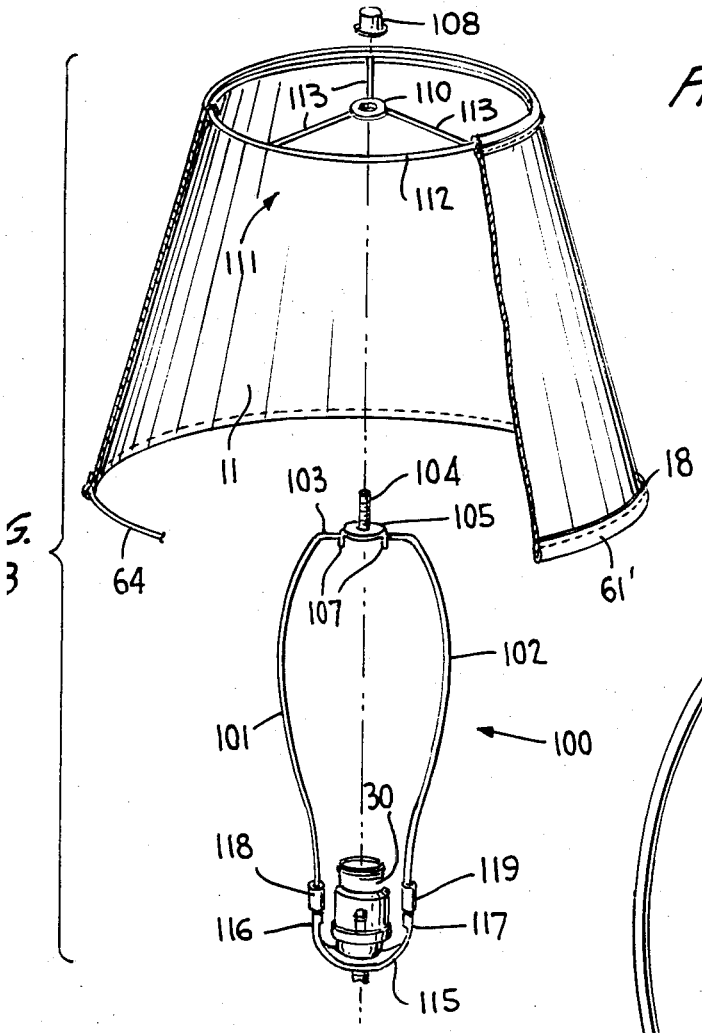
FIG. 21
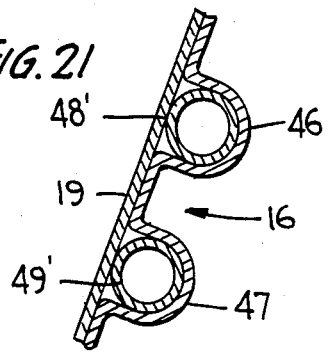
FIG. 20
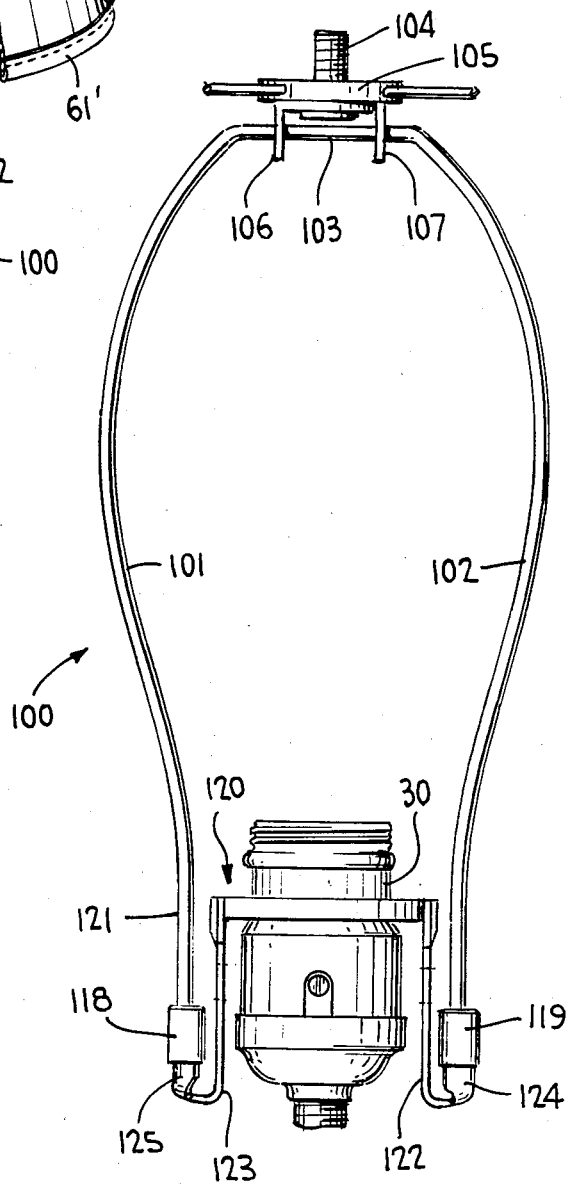
FIG. 19
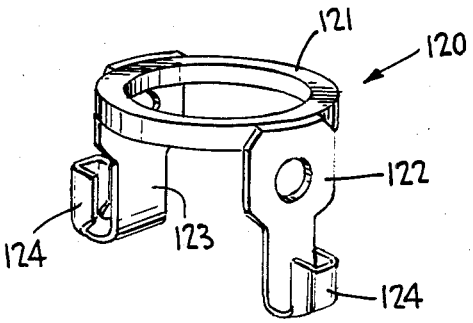

COLLAPSIBLE LAMP SHADE

BACKGROUND OF THE INVENTION 1.
Technical Field

The present invention relates to improvement in lamp shades and, more particularly, to collapsible lamp shades which can be folded or rolled for storage and/or shipping and which can be easily installed on a lamp unit.

2. Discussion of the Prior Art

Commercially available lamp shades are generally supplied by the manufacturer in a pre-formed, fully assembled condition. The shade material itself occupies relatively little space, but the assembled shade occupies unduly large amounts of space, most of which is nothing but air. Since shipping and storage space is expensive, the pre-assembly of lamp shades results in greater expense for the manufacturer and retailer, all of which is passed on as higher cost to the consumer.

It has been suggested that storage and shipping expense can be reduced by stacking lamp shades, particularly those shades having some degree of taper resulting in a generally frustoconical configuration. It has been found, however, that stacking tends to damage trim strips, pleating, and other irregular decorative surfaces on the shades. Moreover, merchandising considerations require that certain lamp shades be individually shipped and stored in their own packages for convenient delivery to a customer. Further, when the lamp shades are shipped together with lamp bases, the heavier base can, and often does, cause considerable damage to the more fragile shades when the packages are jostled during shipping.

It is known in the prior art to provide collapsible or knockdown lamp shades which can be rolled or folded into a compact size for shipping and storage. These collapsible shades are intended to be assembled and mounted on a lamp unit by the end user or customer. For example, such collapsible lamp shades are disclosed in U.S. Pat. Nos. 2,819,386 (Linderoth); 3,022,417 (Linderoth); 3,385,963 (Washick); 3,557,362 (White et al); 3,780,287 (Fauri); 4,212,052 (Chambourd); 4,275,434 (Borowitz); and 4,383,291 (Gall); and in French Pat. No. 2,405,427 (Leviel). All of these prior art collapsible shades suffer from one or more of the following disadvantages inherent in their design: (1) difficulty in assembly by the consumer; (2) damage when folded and/or rolled up for storage and shipping; (3) limited possible variation in decorative surface cover and trim; (4) limited possible variation in shade shapes; and (5) inability to retain the intended shape when assembled. Further, many of these prior art designs are capable of use with only one type of shade mounting arrangement, thereby severely limiting the usefulness of such designs as replacement shades.

With respect to disadvantage (1), reference is made to the White et al and Fauri patents wherein strips of plastic, or the like, are provided along the top and bottom edges of the shade cover. Each strip has a circumferential channel adapted to receive a rigid hoop frame to secure the cover to the remainder of the lamp unit. The transverse width of the channel opening (i.e., perpendicular to the plane of the rigid hoop) is smaller than the diameter of the hoop frame wire in order that the frame can be properly retained in the channel when the lamp is fully assembled. As a consequence, the sides of the channel must be resiliently spread during the initial part of the assembly in order to admit one side of the hoop into a portion of the channel. Since the channel depth does not provide diametrical clearance for the hoop in this partially assembled condition, at least one sidewall of the channel (usually the bottom sidewall) must also be resiliently distortable inwardly of the channel so that the remainder of the hoop can forcibly bend with sidewall into the channel while that side of the hoop is being snapped into the channel. This procedure has proven difficult for many consumers. Moreover, the requirement that one or both sidewalls of the channel be made of resiliently deformable material, permitting opening and closing of the channel during the assembly operation, is in partial conflict with the requirement that the material be sufficiently rigid to retain the hoop in the channel during use. Add to this the fact that the shade is to be stored and shipped in a rolled or folded position, requiring deformation of the channel transversely of the channel length. It can be seen from these diverse requirements that the choice of material for the channel-defining material becomes somewhat limited. Quite often the transverse bends and folds effected during storage/shipping produce permanent deformations in the strips. As a consequence, it has been proposed that the channel strips be shipped and stored disassembled from the shade cover and then attached to the cover by the consumer at the time of assembly. This additional assembly step, however, is disadvantageous since it has proven too difficult for many consumers, particularly if the attachment is to be permanent in nature. It the atachment is not permanent, inadvertent detachment and resulting collapse of the shade is a real possibility. Apart from all of these difficulties, it must be remembered that these prior art collapsible shades have hoop-receiving channels at both the upper and lower edges of the shade, and that manipulation of the shade during insertion of the lower hoop can bring about disengagement of the upper hoop, or vice verse.

Some of the noted above difficulties are addressed by the Gall patent wherein the hoop receiving channel opening is wider than the hoop wire diameter, and wherein the channel depth provides sufficient diametrical clearance to enable the initially inserted portion of the hoop to be pushed deep within the channel while the remainder of the hoop is worked into the remainder of the channel. Tapering of the channel walls automatically centers the inserted hoop. This structure eliminates the need to deform the channel sidewalls during insertion; however, since the channel sidewalls require no deformation during assembly, it stands to reason that no such deformation is required for disassembly. As a consequence, the hoop and shade cover can become inadvertently dissociated from one another when the lamp is jostled or otherwise disturbed as may be the case during dusting, movement, or even actuation of the lamp unit. In addition, the channel strip in the Gall patent is subject to permanent deformation when folded or rolled for shipping or storage. Finally, the working of the hoop into the bottom channel can readily dislodge the hoop from the top channel, and vice versa, making assembly a somewhat cumbersome procedure.

OBJECTS AND SUMMARY OF THE INVENTION

It is therefore an object of the present invention to provide an improved collapsible lamp shade in which the disadvantages enumerated above are eliminated.

It is another object of the present invention to provide a collapsible lamp shade that is easily assembled onto a lamp unit by ordinary purchasers/consumers and which is not subject to being readily inadvertently dislodged from its assembled position.

Another object of the present invention is to provide a collapsible lamp shade in which each of the top and bottom edges of the shade can be rigidified during assembly without dislodging of disassembling the rigidifying structure at the other edge of the shade.

It is a further object of the present invention to provide a collapsible lamp shade having a permanent frame-receiving channel which is not subject to permanent distortion when the shade is folded or rolled.

Yet another object of the present invention is to provide a method and apparatus for rigidifying the lower edge of a lamp shade without interfering with the upper edge mounting and rigidification structure.

It is still another object of the present invention to provide a collapsible lamp shade that is easily assembled on a lamp unit and is not subject to permanent deformation when folded or rolled for storage and/or shipment.

An additional object of the present invention is to provide apparatus for rigidifying the lower edge of a lamp shade while simultaneously radially contracting the upper edge of the lamp shade so as to positively engage the shade on a mounting frame.

In accordance with the present invention a collapsible lamp shade includes a shade cover with a channel defined on its interior surface, preferably adjacent the upper edge of the shade, for receiving a hoop or other shade frame member secured to the lamp unit. The channel has an inwardly facing opening that is wider than the thickness of the frame member and is defined between upper and lower channel-defining sidewalls, both of which extend inwardly from the interior surface of the cover to beyond the periphery of the frame or hoop received in the channel. The lower channel-defining member is resiliently compressible in thickness to facilitate insertion and retention of the frame in the channel. In the preferred embodiment the channel is defined by an elongated cloth strip or tape extending about the entirety of and secured to the interior surface of the cover proximate the upper edge. The strip is preferably two ply thick and is stitched along seams extending longitudinally of the strip to define two transversely-spaced sleeves. Inside each sleeve is a respective insert comprising a length of transversely and resiliently compressible material, such as twine, foam, rubber, hollow plastic or rubber tubing, etc., extending along the entire length of the strip. The resiliently deformable thickness of the insert permits the frame member to be easily forced into the channel without damage to the channel-defining member. The sleeves, with their respective inserts, may be viewed as respective channel-defining ribs having resiliently compressible or deformable thicknesses but having sufficient rigidity to support the shade cover on the frame. The channel depth provides insufficient diametric clearance or "play" to enable displacement of the frame from the channel without forcefully distorting one or both ribs.

In order to rigidify the bottom edge of the shade in its assembled condition, a bottom sleeve is secured circumferentially along either the interior or exterior surface of the cover, proximate the lower edge of the shade. A length of wire, for example common piano wire, is arcuately pre-biased to a specified radius of curvature and can be longitudinally inserted (i.e., threaded) through the bottom sleeve. The size of the pre-biased radius of curvature depends upon the ultimate shade configuration. For example, in a frusto-conical shade in which the lower edge has a larger diameter than the upper edge, the wire has a pre-biased radius of curvature that is at least as great as preferably greater than the desired radius of the lower edge of the assembled shade so as to bias that lower edge radially outward of the assembled shade. Other shade configurations may require an inward bias. The wire length is preferably greater than the shade cover periphery at the bottom sleeve location so that the ends of the wire overlap and avoid any discontinuity and resulting deformities in the lower portion of the assembled shade. The lower sleeve may be provided by a strip of material secured along the interior surface of the shade cover for the dedicated purpose of receiving the rigidifying wire. Alternatively, the lower sleeve may be defined on the outer surface of the cover as part of a decorative trim strip for the shade cover exterior.

The wire used to rigidify the lower edge of the shade cover is structurally independent of the shade frame used to support the shade cover and rigidify the upper edge of the shade. Consequently, the wire can be easily threaded into its sleeve, before or after assembly of the cover on the frame, without manipulation of the cover and, therefore disassembling the cover from the frame. Likewise, the assembly procedure for the cover onto the frame does not result in advertent disassembly of the lower edge rigidifying wire. Of equal importance is the fact that the wire, when provided with a pre-biased radius of curvature greater than the radius of the cover at the wire location, causes the lower edge of the cover to expand radially. For frusto-conical shades, this radial expansion causes the circumferentially shorter upper edge to radially contract about the shade frame, thereby causing the frame to be more positively engaged in its receiving channel and precluding any inadvertent dislodging of the frame from the channel.

BRIEF DESCRIPTION OF THE DRAWINGS

The above and still further objects, features and advantages of the present invention will become apparent upon consideration of the following detailed description of specific embodiments thereof, especially when considered with the accompanying drawings wherein like reference numerals in the various figures are utilized to designate like components, and wherein:

FIG. 18 is a view in perspective of the lamp shade of the present invention utilized in conjunction with a harp-type shade mounting arrangement;

FIG. 19 is a view in perspective of an adapter which permits conversion of any conventional lamp shade mounting arrangement to a harp-type mounting arrangement without the need to disassemble the socket member from the lamp base; and FIG. 20 is a view in elevation of the adapter of FIG. 19 assembled onto a lamp socket and showing the harp-type mounting unit engaged by the adapter and FIG. 21 is a view in section of a portion of an embodiment of the lamp shade of the present invention wherein tubing is employed as the rib insert member.

DESCRIPTION OF PREFERRED EMBODIMENTS

Figure 1:
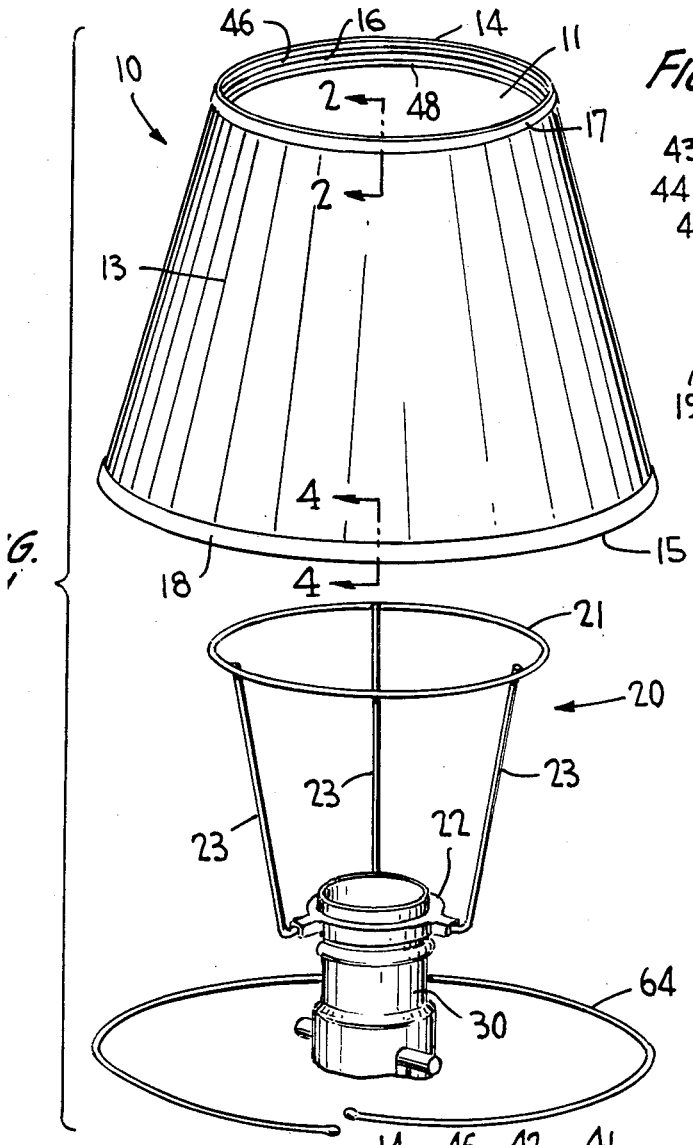
FIG. 1 is an exploded view in perspective of a lamp shade assembled and mounted on a partially shown lamp unit.
Figure 2:
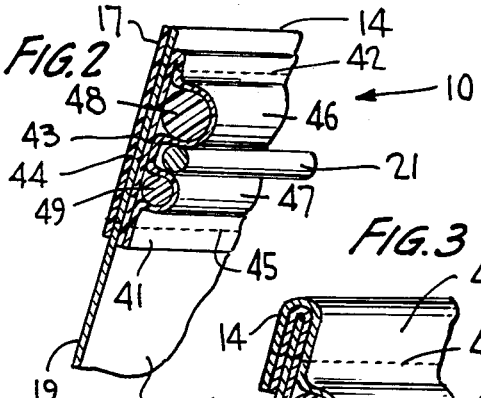
FIG. 2 is a detailed view in section taken along lines 2—2 of FIG. 1.
Figure 6:
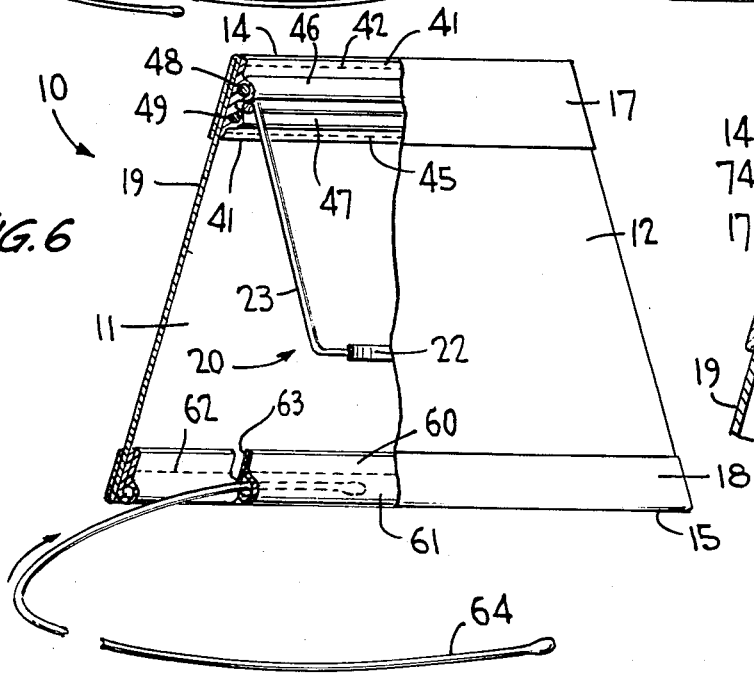
FIG. 6 is a view in elevation and partial section of the lamp shade of FIG. 1 showing the manner in which the lower edge of the shade is assembled and rigidified.

Referring specifically to FIGS. 1, 2 and 6 of the accompanying drawings, a collapsible lamp shade constructed in accordance with the present invention is generally designated by the reference numeral 10. Lamp shade 10 includes a peripherally continuous and generally frusto-conical translucent cover member 19 having an interior surface 11 and an exterior surface 12. The exterior surface is not visible in FIG. 1 because it is covered with a decorative, pleated translucent fabric covering 13. Substantially any decorative covering 13, consistent with the collapsible nature of the shade, may be secured to the exterior surface 12 of the shade cover member 19 in a conventional manner. The outer surface 12 of the cover member 19 is visible in other figures, such as FIG. 6. It is to be understood that the frusto-conical configuration of the cover member is not a limiting feature of the present invention, and that the principals of the present invention are applicable to cylindrical, polyhedral, ellipsoidal, and other shade configurations. Shade cover member 19 has longitudinally spaced upper and lower ends 14 and 15, respectively, defined by respective upper and lower continuous edges of the cover material. For the frusto-conical configuration of the described embodiment, the upper edge 14 has a smaller circumference and diameter than the lower edge 15. The cover member material is translucent and flexible and is preferably a flexible plastic capable of being folded and/or rolled when the shade is stored or shipped. The upper and lower edges of the decorative fabric outer covering 13, proximate the upper and lower edges 14, 15 of the shade cover member 19, are covered with circumferential continuous trim strips 17, 18 of suitable decorative fabric to match or coordinate with the decorative covering 13.

Lamp shade 10 of FIG. 1 is adapted to be mounted on a hoop or support ring 21 of a shade frame member 20. Frame member 20 is of the unofitter type employed on many different lamps and may be made of substantially rigid metal or plastic material. An inner frame ring 22 is adapted to fit concentrically about (and may threadedly engage) the outer surface of a socket member 30. The socket member, as is conventional, supports an incandescent bulb (not shown) at its upper end and is secured to the remainder of the lamp assembly in a conventional manner. Frame 20, therefore, serves as a mounting frame to secure the lamp shade 10 to the lamp assembly. Inner socket ring 22 has a substantially smaller diameter than support ring 21, the two rings being structurally joined to one another in respective parallel and vertically displaced planes by means of plural struts 23. Struts 23 extend from different angular positions at the outer portion of the smaller socket ring 22 to corresponding angular positions at the inner periphery of the larger support ring 21. The outer periphery of support ring 21 is thus continuous and uninterrupted by the struts so that it may be freely received in the support channel provided on shade cover member 19 in the manner described below. It will be appreciated that the frame 20 tapers in a direction opposite to the taper of the shade cover member 19 so that struts 23 diverge from and do not contact the interior surface 11 of the cover member. Support ring 21 is a circumferentially continuous wire having a known diameter (i.e., wire thickness) and has a predetermined outer perimeter (e.g., circumference) with a predetermined hoop diameter.

Shade cover member 19 includes a ring-receiving channel 16 extending circumferentially along the interior cover surface 11 proximate or adjacent upper edge 14. Channel 16 has a depth (i.e., radially outward from the vertical center of the shade and toward interior surface 11) which accommodates support ring 21 such that the outer periphery of ring 21 substantially contacts the channel base. Channel 16 has a transverse opening (i.e., along the longitudinal or vertical dimension of the shade) which is everywhere at least as wide as the thickness (i.e., diameter) of the wire which forms support ring 21. Importantly, there is substantially no horizontal "play" or slack for ring 21 within channel 16 when the shade is assembled on the lamp unit. As will be seen from the description infra, in the preferred embodiment the upper edge 14 of the cover member is actually urged radially inward to positively contact support ring 21.

Figure 16:
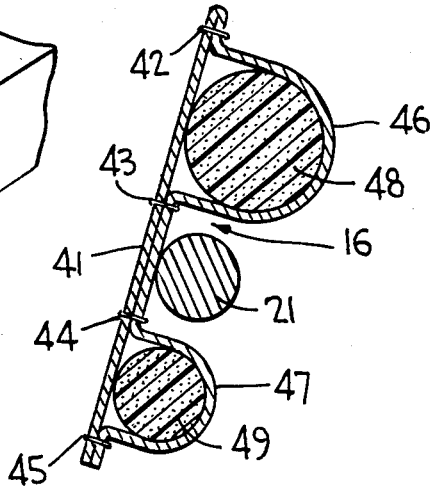
FIG. 16 is a view in section of the channel-defining member utilized to mount the lamp shade of the present invention wherein the upper of the two channel-defining ribs is of larger diameter than the lower channel-defining ribs.

As illustrated in detail in FIGS. 2 and 16 of the accompanying drawings, receiving channel 16 is preferably formed by means of a strip 41 of soft flexible material secured to the interior surface 11 proximate upper edge 14 and extending in a substantially continuous circumferential path. The preferred material for strip 41 is woven cotton, although other soft and flexible material, consistent with the functional requirements described herein, may be employed. Strip 41 is folded longitudinally into a double or two-ply thickness and is stitched together lengthwise at four transversely spaced seams 42, 43, 44, 45 to define two transversely spaced longitudinally-extending sleeves 46, 47 disposed circumferentially along interior surface 11. In other words, one of the plies is provided with sufficient slack to define the two sleeves 46, 47 before the seams are stitched, and the other ply is secured to the interior surface 11 of cover member 19 by means of adhesive, or the like. Strip 41 may, of course, include more than two thickness layers if desired; likewise, the strip need not be folded to provide the two or more plies, but instead may be formed from plural individual strip layers sewn together along their longitudinal edges.

Inside each sleeve 46, 47 there is disposed a elongated insert member 48, 49, respectively. Each elongated member extends longitudinally through substantially the entirety of its respective sleeve and is resiliently compressible in thickness for reasons described below. In addition, the elongated insert members must be flexible so as to be foldable or rollable with cover member 19 when the shade is stored and/or shipped. In the preferred embodiment the elongated members 48, 49 are respective lengths of hemp twine; however, these members may also be lengths of other types of twine, plastic foam or rubber, or plastic or rubber tubing 48', 49' (as illustrated in FIG. 21). Each sleeve 46, 47, with its respective insert member 48, 49, constitutes a channel-defining circumferentially-extending rib at respective sides of channel 16. In the embodiment illustrated in FIG. 2 the upper rib 46, 48, is thicker and projects further inward from interior cover surface 11 than does the lower rib 47, 49. However, both ribs project sufficiently far radially inward from interior surface 11 to overlap or extend radially beyond the outer perimeter or circumference of support ring or hoop 21 when the latter is disposed in channel 16. Further, the spacing between the two ribs, as defined by the spacing between stitched seams 43 and 44, and by the diameters of the elongated insert members 48 and 49, is everywhere at least as great and preferably greater than the diameter of the wire of which support ring 21 is formed. If support ring 21 is formed of a wire or other element that is not circular in cross-section, then the spacing between the ribs must be greater than the thickness dimension of that element in a direction parallel to the interior surface 11 at the base of channel 16.

Figure 12:
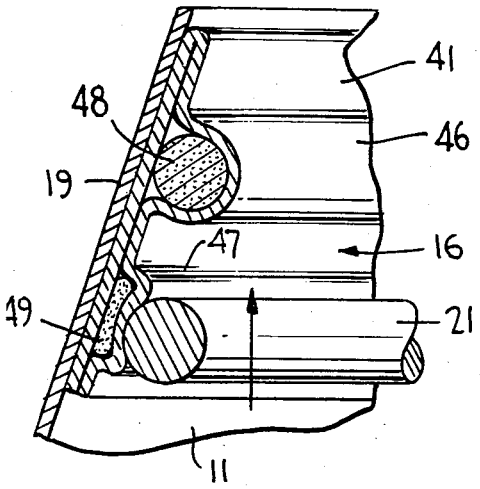
FIG. 12 is a view in section of a portion of the lamp shade of FIG. 1 during assembly, illustrating in detail the radial compression of one of the supporting ribs for the frame member.

Insertion of support ring 21 into channel 16 is effected by taking advantage of the resilient compressibility, in thickness, of lower rib 47, 49. As best illustrated in FIG. 12, support ring 21 is pushed axially upward within the space enclosed by cover member 19 so as to radially compress insert member 49 against interior surface 11 until the ring is disposed in channel 16. Thus, the resiliently compressible thickness of lower rib 47, 49 is what permits and facilitates insertion of support ring into the channel. Once the ring is in the channel, as best illustrated in FIG. 2, the weight of the shade bears down and rests upon support ring 21 through upper rib 46, 48. Thus, the upper rib should not be so compressible in thickness that the weight of the shade causes it to become compressed and dislodge support ring 21 from channel 16. Once the ring is in the channel the lower rib 47, 49 precludes inadvertent dislodging of the ring from the channel if the lamp is moved, or if the shade is jostled, etc. From this it will be appreciated that the resilient compressibility in thickness is a requirement for the lower rib to effect insertion, but is not critical for the upper rib. However, both ribs must be foldable or rollable with the shade cover, without permanent deformation, in order to permit efficient storage and/or shipping of the entire shade 10. We have found that the use of the same material for both insert members 48 and 49 facilitates and reduces the expense of fabrication, and that the aforesaid twine, foam or rubber materials all adequately suit the intended purposes of the insert members.

Figure 3:
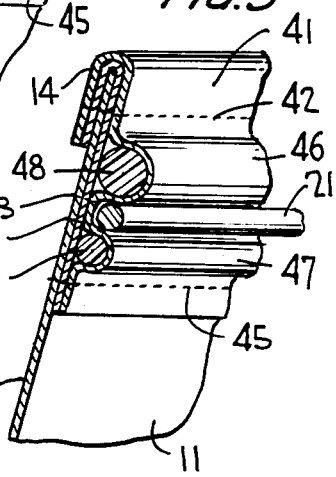
FIG. 3 is a view similar to that of FIG. 2 for an alternative embodiment of the present invention.

In the embodiment illustrated in FIGS. 2 and 16 the strip 41 is disposed only along interior surface 11 of the cover member. As illustrated in FIG. 3, it is also possible for the upper edge of strip 41 to be transversely extended over the top edge 14 of cover member 19 so as to serve as the decorative trim strip along the upper portion of outer surface 12.

Figure 17:
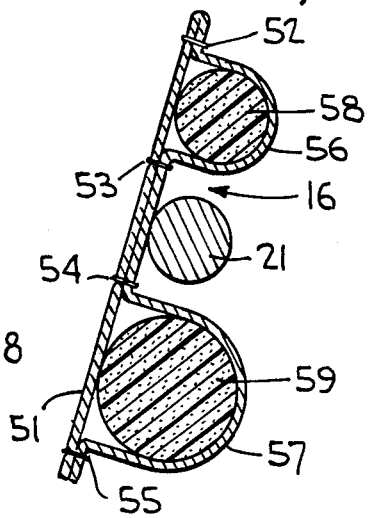
FIG. 17 is a view in section of the channel-defining member utilized to mount the lamp shade of the present invention wherein the lower of the two channel-defining ribs of larger diameter than the upper channel-defining ribs.

The embodiment illustrated in FIGS. 2 and 3 has an upper rib 46, 48 which is thicker (i.e. has a larger diameter) than the lower rib 47, 49. This is aesthetically advantageous in that the support ring 21, when inserted in channel 16, is hidden from view from above the lamp shade. However, this is not a critical feature of the present invention, and the two ribs can be made of equal thickness, or the lower rib may be made thicker than the upper rib. The latter configuration is illustrated in FIG. 17 wherein the strip is designated by reference numeral 51 and the narrower upper rib includes sleeve 56 defined between stitched seams 52 and 53. The wider, lower rib includes sleeve 57 defined between stitched seams 54 and 55. The smaller diameter insert member 58 is disposed in sleeve 56, whereas the larger diameter insert member 59 is disposed in sleeve 57. In either embodiment, the stitched seams defining the sleeves are preferably positioned such that the sleeves are tautly stretched transversely over the insert members, without distorting the insert members, so that there is substantially no transverse slack between the sleeve and its insert member. As an example of the relative sizes in a typical embodiment, the diameter of the wire cross-section for ring 21 is 7/64 inch, the diameter of the larger rib 46, 48 or 57, 59 is 3/16 inch, and the diameter of the smaller rib 47, 49 or 56, 58 is ⅛ inch; the ribs are centered 11/32 inch apart to provide a minimum width for channel 16 of 6/32 inch. This channel width, it will be seen, is some 5/64 inch wider than the diameter of the wire cross-section for ring 21.

It is to be understood that in the embodiment illustrated in FIG. 1, the inter-engagement between channel 16 and support ring 21 serves two functions. First, as described above, the support ring serves as a mounting structure which supports the lamp shade on the lamp assembly. Second, the support ring serves to rigidify the upper edge of the shade to preclude that edge from collapsing from its annular (or other) mounted position. It is also possible, of course, to displace channel 16 from its preferred position adjacent upper edge 14 to some other location along cover member 11 intermediate edges 14 and 15, depending upon the actual shape of the shade. In any event, the channel 16 and ring 21 interact to perform the same two functions.

Figure 4:
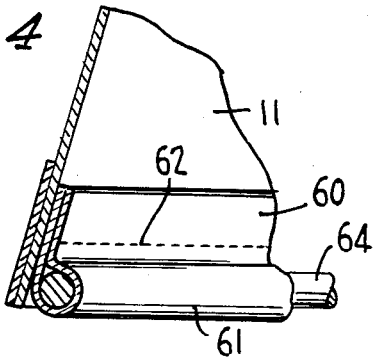
FIG. 4 is a detailed view in section taken along lines 4—4 of FIG. 1.

Referring to FIGS. 1, 4 and 6 of the accompanying drawings, in order to rigidify the bottom edge of the shade 10 of FIG. 1, a bottom sleeve 61 is formed from a further strip 60 of soft flexible material and is secured circumferentially along interior surface 11 proximate lower edge 15. Strip 60 may be made of the same material as strip 41. In the illustrated embodiment strip 60 is merely folded over onto itself and stitched at 62 to define sleeve 61 between the stitched seam 62 and the fold. An access opening 63 is defined in sleeve 61 in order to permit a rigidifying wire 61 to be threaded or longitudinally inserted into the sleeve. Wire 64 may simply be a length of piano wire with separate defined ends determining a length that is preferably slightly greater (e.g., three to five inches longer) than the circumferential length of sleeve 61. In addition, wire 64 is arcuately biased or performed with a radius of curvature at least equal to and preferably greater than the radius of the circle defined by sleeve 11 about the longitudinal center line or axis of cover member 11.

Once wire 64 has been inserted into sleeve 61, the opposite ends of the wire overlap and are tucked into opposite sides of access opening 63 to assure that there is no break in the rigidifying presence of the wire in the sleeve. Moreover, the arcuate bias serves as a structural "memory" to assure that the lower edge 15 has a circular configuration. In addition, because of its arcuate bias, and because wire 64 is structurally independent of frame 20, wire 64 tries to expand radially outward in sleeve 61 and thereby urges the lower edge 15 of cover member 19 radially outward. For the frusto-conical shade configuration illustrated in FIGS. 1 and 6, this outward urging of lower edge 15 tends to radially compress upper edge 14 toward ring 21 to thereby assure that the ring is deeply inserted into the channel 16. The interaction of wire 64 and sleeve 61, therefore, serves two functions, namely rigidifying the lower edge 15 of the shade, and forcefully engaging support ring 21 in mounting channel 16.

Figure 15:
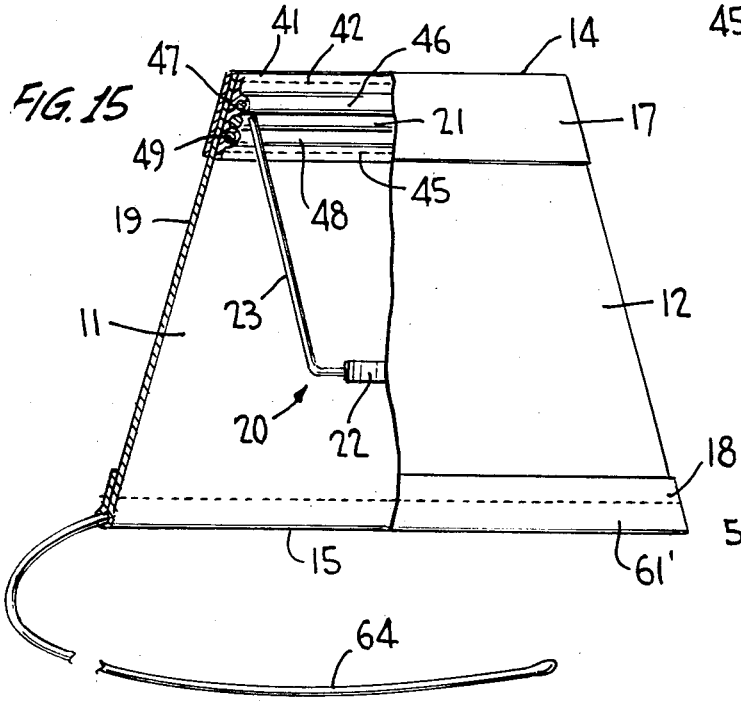
FIG. 15 is a view similar to that of FIG. 6 and illustrating another embodiment of the lamp shade of the present invention whereby the lower edge of the shade is rigidified.

In the embodiment illustrated in FIGS. 1, 4 and 6, wire 64 is disposed in a specially provided sleeve 61 oriented circumferentially along the interior surface 11 of cover member 19 proximate lower edge 15. As illustrated in FIG. 15, it is also possible to dispose wire 64 in a sleeve 61' defined in the lower decorative trim strip disposed on the exterior surface 12 proximate lower edge 15 of shade cover member 15. Wire 64 and sleeve 61' perform the same function described above in connection with wire 64 and sleeve 61, and provide the additional advantage of eliminating the need of a specially provided separate strip 60.

Figure 5:
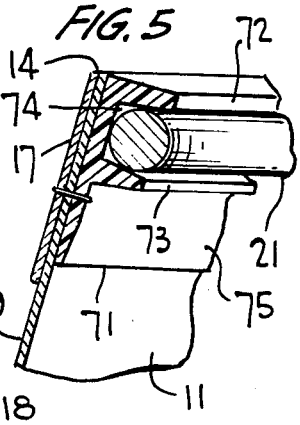
FIG. 5 is a view similar to FIG. 2 of still a further embodiment of the present invention.

It is preferred that channel strip 41 and lower sleeve strip 60, 18 be made of cotton, rayon or some similar soft and pliable fabric material to facilitate rolling and/or folding of the strips along with the shade cover without causing permanent deformation of the strip. As a general rule, if a plastic material is used for the channel-defining members, the material tends to resist folding and/or rolling of the shade and, at the very least, becomes creased or permanently deformed when so folded or rolled. In some cases, where these disadvantages can be tolerated, or where a sufficiently soft plastic material can be used, a simple extruded strip 71 may be employed as illustrated in FIG. 5. Strip 71 has a flat back or reverse surface secured to interior surface 11 of cover member 19 proximate upper edge 14. The strip may be secured to surface 11 by adhesive, ultrasonic bonding, or any conventional technique. Upper and lower channel-defining projections 72, 73 are formed at the obverse surface of the strip and extend radially inward to define a ring-receiving channel 74 therebetween. The channel extends circumferentially along surface 11 and has an inwardly facing opening which is wider than the diameter of the cross-section of the wire forming the ring 21. Both of the projections 72 and 73 extend inwardly to respective locations beyond the outer circumference of ring 21. A lower portion 75 of strip 71 extends downwardly a short distance along exterior surface 11 of the cover member and serves to provide additional reverse surface area along which strip 71 may be adhered to surface 11. This lower portion of the strip may be eliminated, if desired. Lower projection member 73 is relatively thin and tapers to a very small thickness at its inwardly facing distal edge so as to render that edge more readily resiliently distortable and thereby to facilitate insertion of the frame ring 21 into channel 74. In this regard, during insertion of the ring, the distal edge of member 73 acts as a lip and is flexed inwardly of the channel by the ring until the ring passes the lip and is positioned within the channel. The lip then returns to its unflexed position to define the lower side wall of channel 74. The thicker upper projection 72 is not as transversely bendable as the lower projection 73 and serves as the weight bearing member by which the weight of the shade rests on frame ring 21 without flexure of the member 72.

Figure 7:
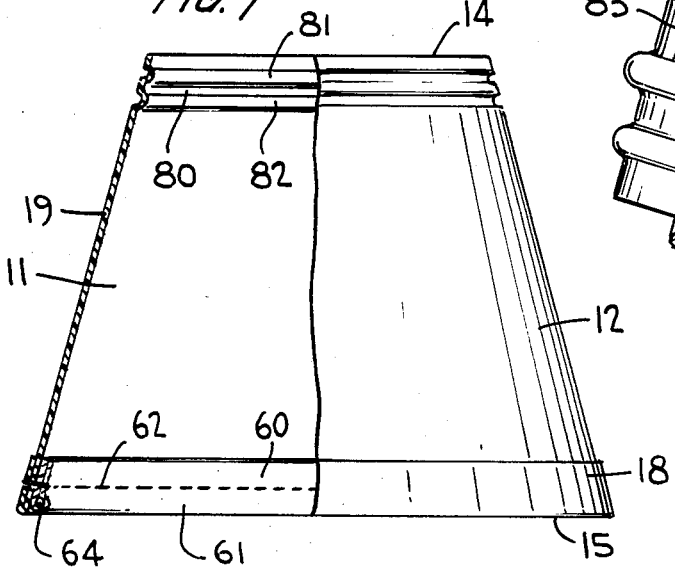
FIG. 7 is a view in elevation and partial section of another lamp shade constructed in accordance with the principles of the present invention.
Figure 8:
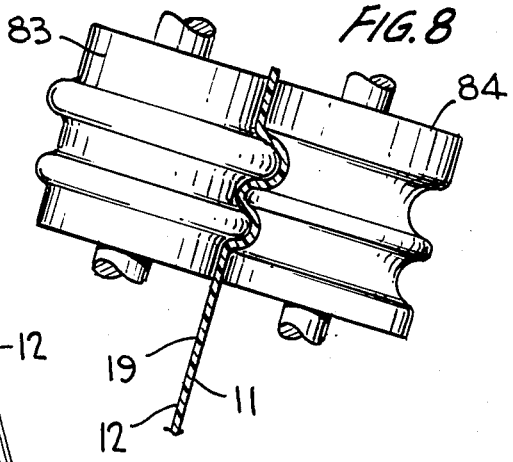
FIG. 8 is a detailed view of apparatus for forming a portion of the lamp shade of FIG. 7.

Another technique for providing the ring-receiving channel is illustrated in FIGS. 7 and 8 to which specific reference is now made. In this technique a channel 80 is defined between upper rib 81 and lower rib 82 which are permanently formed in the shade cover itself. The ribs 81, 82 have the same size and shape requirements as the ribs described in relation to FIG. 1 and, since they are formed as an integral part of the cover, are foldable and/or rollable with the cover material without significant permanent deformation. One technique for forming ribs 81, 82 is by passing the cover member 19 between two mating embossing rollers 83, 84 while the cover material is at an elevated temperature to render the material more pliable than it is at room temperature. Upon cooling the cover material, the ribs remain as a permanent deformation in the structure. The flexibility of the cover material itself provides the resilient deformation necessary to permit insertion of the frame ring 21 into channel 80.

Figure 11:
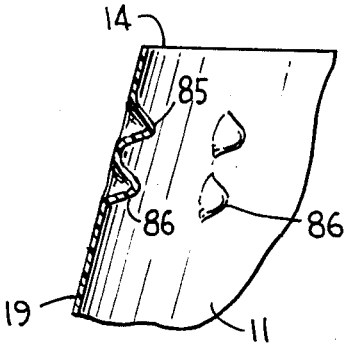
FIG. 11 is a detailed view in section taken along lines 11—11 of FIG. 9.
Figure 9:
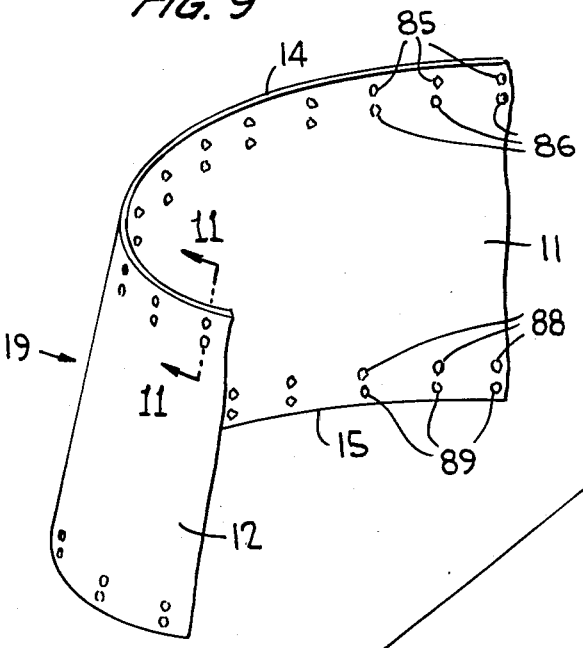
FIG. 9 is a view in perspective of a portion of another lamp shade cover constructed in accordance with the principles of the present invention.
Figure 10:
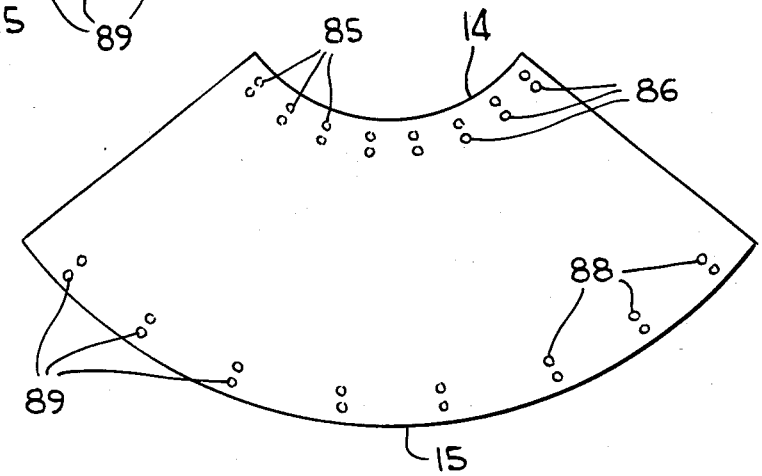
FIG. 10 is a view in plan of the lamp shade cover of FIG. 9.

To the extent that the deformed cover material limits free folding or rolling of the preformed ribs 81, 82, it is possible to modify the preformed channel in a way that alleviates the problem. As illustrated in FIGS. 9, 10 and 11, instead of having the preformed channel-defining members extending as circumferentially continuous projections, the two channel-defining members can be two respective rows 85, 86 of angularly spaced dimples preformed in the shade cover member 19. Folding or rolling of the cover member is facilitated since there is no extended length of the channel side walls, and the folds and bends occur primarily in the cover material space existing between the dimples. The spacing between the rows, and the extent of their inward projection, follow the same considerations set forth above for ribs 46, 48 and 47, 49 of channel 16. A similar pair of dimple rows 88, 89 is provided proximate the lower edge 15 to receive a rigidifying lower ring (not shown) of the type described below in relation to FIG. 13. Alternatively, a sleeve 61 and wire 64 may be employed in the manner described in relation to the embodiment illustrated in FIG. 1.

Figure 13:
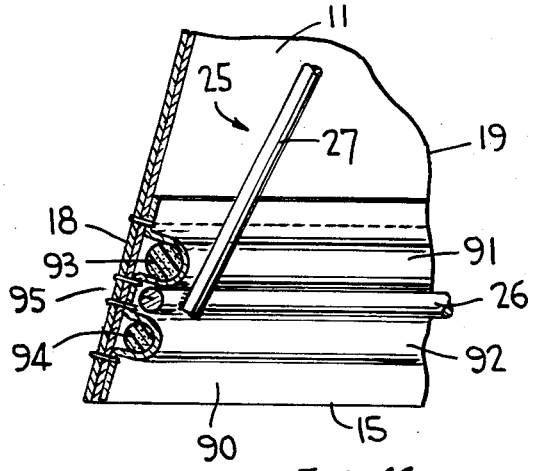
FIG. 13 is a detailed view in section of a lower portion of a shade constructed in accordance with another embodiment of the present invention.

The same type of channel-defining arrangement used at the top edge of the shade of FIG. 1 may also be employed at the bottom edge of the shade in place of the wire and sleeve rigidifying structure. With reference to FIG. 13, a strip 90 of soft, flexible material is sewn or otherwise secured to interior surface 11 of cover member 19 to extend circumferentially about the shade at a location proximate lower edge 15. In the illustrated embodiment, strip 90 is a single ply strip sewn with stitches extending through the lower material and through the lower edge decorative trim strip 18. It is to be understood, however, that strip 90 could be the same type two-ply strip used for top strip 41 in the embodiment of FIG. 1. Likewise, a single ply strip sewn directly to the shade cover may be employed for strip 41 and the other strips described herein. Upper and lower sleeves 91 and 92, respectively, defined by strip 90 and interior surface 11, are filled with inserts 93 and 94, respectively, of the type described above for inserts 48, 49. The resulting channel 95, defined between upper rib 91, 93 and lower rib 92, 94, receives a lower ring 26 of a modified unofitter frame 25. Specifically, frame 25 is similar to frame 20 (FIG. 1) but additionally includes a lower hoop or ring 26 supported below inner socket ring 22 (not shown in FIG. 13) by means of downwardly extending struts 27 which are similar to struts 23. The ribs are resiliently compressible to permit ring 26 to be inserted into channel 95. Typically, ring 26 and ring 21 (FIG. 1) are inserted into their respective channels 95 and 16 simultaneously by resiliently compressing the two lower ribs 92, 94 and 47, 49 simultaneously as the frame is moved vertically upward inside the enclosure defined by shade cover 19. It should also be understood that a ring similar to ring 26, but not attached to the unofitter may be employed in channel 95 to rigidify the bottom of the shade.

Figure 14:
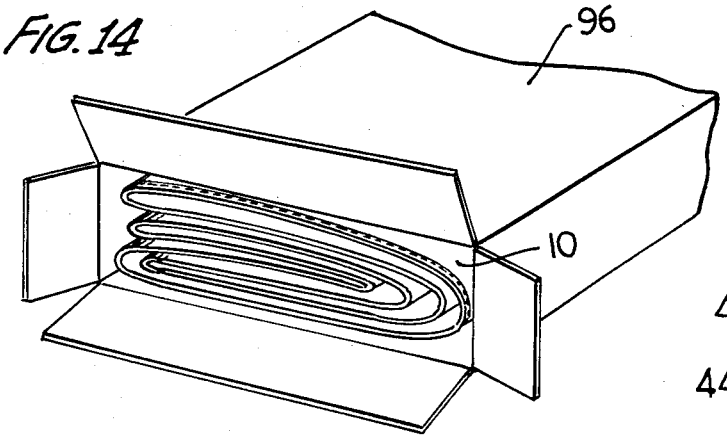
FIG. 14 is a view in perspective of a carton containing a collapsible shade of the present invention, folded for storage.

FIG. 14 illustrates the collapsible shade 10 multiply-folded in its collapsed state and disposed in a storage/-shipping carton 96.

The present invention is not limited to use with unofitter type frames 20, 25. As indicated above, the collapsible shade is equally useful with conventional harp-type lamp shade mounting arrangements. Referring to FIG. 18, a conventional harp structure 100 includes two spring arms 101, 102 integrally joined at a top cross piece 103 serving as a vertex. A mounting stud 104 is secured to a mounting plate 105 pivotally connected to cross piece 103 via two depending journal flanges 106, 107. Stud 104 is adapted to be received in an inner ring 110 of a planar hoop-type frame 111. Frame 111 includes an outer or support ring 112 adapted to fit into channel 16 (FIG. 1) in the same manner that ring 21 (FIG. 1) fits into that channel. Ring 112 is rigidly secured to inner ring 110 by radial spokes or struts 113. In essence, planar frame member 111 and its outer ring 112 serve the same function as the unofitter frame member 20 and its outer ring 21. Stud 104, which extends in an opposite direction to spring arms 101, 102 from the harp veretx, has its distal end threaded to be engaged by a nut 108 which secures frame 111 to the harp. Typically, the distal ends of the spring arm 101, 102 are resiliently compressed toward one another and inserted into respective upstanding receptacles 116, 117 of a harp leg member 115 that is secured to the lamp assembly in a conventional manner just below the socket member 30. Receptacles 116, 117 project upwardly on opposite sides of socket member 30 to receive the distal ends of the spring arms. Retainer caps 118, 119 are captivally and slidably engaged on respective spring arms 101, 102 and are adapted to slide over a respective receptacle 116, 117 to retain the distal ends of the spring arms in the receptacles.

The collapsible lamp shade of the present invention can be sold as part of an original lamp or may be sold as a replacement for existing lamp shades. It is important, when the shade is sold as a replacement shade, that the shade be mountable on substantially any lamp. There are many lamps using unofitter or hoop-type shade mounts which are non-standard and, therefore, the rings 21, 112 of the original lamp mounting may not fit the replacement shade channel. Moreover, if the replacement shade is longer or shorter than the original, the original harp mount may not support the shade at the proper height relative to the socket and base. For these reasons the shade of the present invention, when sold as a replacement shade, may have a planar frame 111 and a harp unit 100 included therewith. In addition, a harp mounting adapter 120, as illustrated in FIGS. 19 and 20, is provided with the replacement shade to assure that the harp unit can be used with any lamp having a standard socket member 30. Adapter 120 includes a ring 21 of generally similar size and shape to ring 22 in unofitter 20 illustrated in FIG. 1. Ring 121 is adapted to be disposed about socket member 30, as illustrated in FIG. 20. In this regard, the interior surface of the ring 121 may be internally threaded to mate with the external threads on socket member 30. Alternatively, the ring 121 may be provided with a plurality of angularly spaced inwardly projecting teeth adapted to firmly engage the exterior surface of socket member 30. Still another alternative, such as that actually illustrated in Figs. 19 and 20, permits the ring 121 to merely rest on the beveled outer shoulder formed on standard socket member configurations. Two depending legs 122, 123 extend from diametrically opposite locations at the outer periphery of ring 121 in a downward direction. Legs 122 and 123 have generally J-shaped configurations such that their distal ends turn upwardly in a substantially 180-degree bend and form receptacles 124, 125, respectively. Receptacles 124 and 125 and adapted to receive the distal ends 102, 101, respectively of the harp spring arms. Legs 122 and 123 are configured to place receptacles 124 and 125 at the proper height to receive the distal ends of the spring arms whereby the lamp shade is supported, relative to socket member 30, at the appropriate height for the given shade. It will be appreciated, therefore, that adapter 120, when supplied to a consumer along with frame 111, harp member 100 and the collapsible lamp shade of the present invention, will permit that shade to be mounted on substantially any conventional-type lamp, irrespective of the type of shade mounting previously employed with that lamp.

As indicated above, the two inserts 48, 49 may be made of the same material. Of course, this is not a limiting feature on the present invention since insert 49 is required to be resiliently compressible in thickness whereas this is not a requirement for insert 48. In addition, although it is preferred that the arcuately prestressed plastic or metal wire 64 be used in conjunction with a sleeve 61 or 61' to rigidify the lower edge of the shade, other techniques for such rigidification may be employed in connection with the ring-mounting channel illustrated in FIG. 2. By the same token, the lower edge rigidifying technique involving wire 64 and sleeve 61 may be used with or without the ring-receiving channel arrangement illustrated in FIG. 2.

It will be appreciated that the double ribbed strip 41 used at the top of the shade, and the single sleeve strip 61, 61′ used at the bottom of the shade, can be easily produced and cut to desired lengths as part of an inexpensive fabrication process. No special extrusion dies or other special equipment are required during the manufacturing process.

The channel 16 for receiving frame 21 is sized to receive standard frame rings used in conventional lamps and is therefore useful, without additional components, as a replacement shade for most existing lamps. The wire 64 may simply be part of a coil of piano wire and is cut to a specified length for insertion in each shade as it is produced.

The collapsible shade of the present invention is easily assembled by even the most unskilled of customers. It is only necessary to force the frame 21 past the compressible lower rib 47, 49 and into the channel 16, and then slide the wire 64 into the bottom shade sleeve 61, 61′. No tools or special handling is required. Importantly, since wire 64 is structurally independent of frame 20, or frame 111, the threading of the wire 64 into the sleeve does not result in disengagement of channel 16 from ring 21. Likewise, if wire 64 is inserted into channel 61 first, the latter engagement of ring 21 by channel 16 does not dislodge wire 64 from its sleeve.

It will be appreciated that the collapsible shade of the present invention can take a variety of shapes, such as the illustrated frusto-conical shape, a drum or cylindrical shape, an ellipsoidal shape, or even a polyhedral shape. With respect to polyhedral shade configurations, the frame-receiving upper channel would have multiple sides corresponding to the polyhedral configuration; it is contemplated that, for this embodiment, the wire 64 and its associated sleeve 61 would not be appropriate.

The fact that the upper double rib and the bottom sleeve can be made of a soft cloth material permits the shade to be folded substantially flat without any fear of permanent damage or deformation. Since the ribs and sleeve can be formed on a standard sewing machine, they can be made out of a fabric which matches the outside decorative covering 13 so as to be considerably more attractive than injection-molded or extruded plastic strips. As indicated above in relation to FIG. 3, the fabric from which the strip 41 is formed, can be folded over the top edge 14 of the shade to serve as the decorative upper edge trim.

From the foregoing description it will be appreciated that the invention makes available a novel collapsible lamp shade capable of being easily installed on a lamp unit but which is not permanently deformable when folded or rolled up for storage and/or shipping. In addition, the lamp shade of the present invention can be provided with a wide variety of decorative coverings on its exterior surface without inhibiting the desirable collapsibility and easy installation capability.

Having described preferred embodiments of a new and improved collapsible lamp shade constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A collapsible lamp shade capable of being folded or rolled for storage or shipping and removably supported on a lamp assembly by a shade frame member having a predetermined perimeter configuration and a known thickness, said lamp shade comprising:

a cover member of flexible material having a peripherally continuous configuration with first and second longitudinally spaced open ends defined by respective upper and lower continuous edges of said material, said cover member having interior and exterior continuous surfaces;

support means projecting inwardly from said interior surface for assembling said cover member on said frame member, said support means including first and second channel-defining members projecting inwardly and extending along said interior surface for defining a channel configured to receive said predetermined perimeter of said frame member, said first and second channel-defining members being transversely spaced from one another longitudinally along said interior surface of said cover member, each of said channel-defining members projecting inwardly of said interior surface beyond said predetermined perimeter of said frame member received in said channel;

wherein said channel has an opening facing inwardly of said cover member, said opening having a width dimension extending longitudinally of said interior surface and transversely of said channel, said width dimension being at least as great as said known thickness of said frame member;

wherein said second channel-defining member is disposed below said first channel-defining member along said cover member assembled on said frame member;

wherein said second channel-defining member is temporarily distortable during assembly of said cover member on said frame member to permit insertion of said predetermined perimeter into said channel; and wherein said second channel-defining member comprises: an elongated member extending in a substantially continuous path along said interior surface, said elongated member being resiliently compressible in thickness to provide the said temporary distortability during assembly; and retention means, secured to said interior surface, for supporting said elongated member substantially adjacent said interior surface.

2. The lamp shade according to claim 1 wherein said elongated member is a length of transversly and resiliently compressible twine.

3. The lamp shade according to claim 1 wherein said elongated member is a length of transversely and resiliently compressible foam material.

4. The lamp shade according to claim 1 wherein said elongated member is a length of transversely and resiliently compressible plastic tubing.

5. The lamp shade according to claim 1 wherein said retention means comprises a strip of soft flexible material secured to said interior surface and having an elongated sleeve enclosing said elongated member.

6. The lamp shade according to claim 2 wherein said frame member includes a rigid outer ring of wire-like material having a generally circular cross-section, wherein the known thicknesses of said frame member is the diameter of said generally circular cross-section, and wherein said predetermined perimeter of said frame member is defined by the radial extremity of said outer ring;

wherein said frame member further includes:

an engagement member for engaging said lamp assembly at a location interiorly spaced from the interior surface of said cover member; and a plurality of angularly spaced struts extending between said engagement member and said ring to secure said ring relative to said engagement member;

wherein said lamp assembly includes: a socket member having an upper receiving portion for supporting a light source in a space surrounded by said interior surface; and a harp member having two spring arms joined at a vertex for resilient mutual angular contraction, said arms each having a distal end, said harp member including a stud extending from said vertex in a direction substantially opposite said spring arms;

wherein said engagement member comprises means secured to said lamp assembly for engaging said distal ends of said spring arms on opposite sides, respectively, of said socket member; and wherein said frame member includes an inner ring adpated to receive said stud member to secure said frame member to said lamp assembly, said inner and outer rings being disposed substantially co-planar; and wherein said engagement member comprises an adapter having an annular portion removably secured to and disposed about said socket member, and first and second receptacles secured to opposite sides of said annular portion receiving the distal ends of said first and second spring arms, respectively, the spacing between said first and second receptacles being less than the spacing between said distal ends of said first and second spring arms in an unstressed state, and wherein said annular portion has an inside diameter greater than the uppermost portion of said socket member to permit said adapter to be assembled on said socket member from above when said light source is removed from said socket member.

7. A collapsible lamp shade capable of being folded or rolled for storage or shipping and removably supported on a lamp assembly by a shade frame member having a predetermined perimeter configuration and a known thickness, said lamp shade comprising:

a cover member of flexible material having a peripherally continuous configuration with first and second longitudinally spaced open ends defined by respective upper and lower continuous edges of said material, said cover member having interior and exterior continuous surfaces;

support means projecting inwardly from said interior surface for assembling said cover member on said frame member, said support means including first and second channel-defining members projecting inwardly and extending along said interior surface for defining a channel configured to receive said predetermined perimeter of said frame member, said first and second channeldefining members being transversely spaced from one another longitudinally along said interior surface of said cover member, each of said channel-defining members projecting inwardly of said interior surface beyond said predetermined perimeter of said frame member received in said channel;

wherein said channel has an opening facing inwardly of said cover member, said opening having a width dimension extending longitudinally of said interior surface and transversely of said channel, said width dimension being at least as great as said known thickness of said frame member;

wherein said second channel-defining member is disposed below said first channel-defining member along said cover member assembled on said frame member;

wherein said second channel-defining member is temporarily distortable during assembly of said cover member on said frame member to permit inspection of said predetermined perimeter into said channel; and wherein said first and second channel-defining members include respective first and second resiliently and transversely compressible elongated members extending in substantially continuous respective paths along said interior surface; and retention means, secured to said interior surface, for supporting said first and second elongated members adjacent said interior surface.

8. The lamp shade according to claim 7 wherein said retention means comprises a strip of soft and flexible material secured to said interior surface, said strip having first and second transversely spaced sleeves enclosing said first and second elongated members, respectively.

9. The lamp shade according to claim 8 wherein said second elongated member is thicker than said first elongated member.

10. The lamp shade according to claim 8 wherein said first elongated member is thicker than said second elongated member.

11. The lamp shade according to claim 8 wherein said first and second elongated members have generally circular cross-sections with diameters of approximately 3/16 inch and $\frac{1}{8}$ inch, respectively, and wherein said frame member includes a hoop formed of a wire having a generally circular cross-section with a diameter of 7/64 inch.

12. The lamp shade according to claim 8 wherein said first and second elongated members are first and second lengths, respectively, of transversely compressible twine.

13. The lamp shade according to claim 8 wherein said strip is a two-ply strip of cloth with both plies sewn together at transversely spaced locations to define said sleeves.

14. The lamp shade according to claim 13 wherein a portion of said strip is folded over said upper edge of said cover member and secured to said exterior surface.

15. A collapsible lamp shade capable of being folded or rolled for storage or shipping and removably supported on a lamp assembly by a shade frame member having a predetermined perimeter configuration and a known thickness, said lamp shade comprising:

a cover member of flexible material having a peripherally continuous configuration with first and second longitudinally spaced open ends defined by respective upper and lower continuous edges of said material, said cover member having interior and exterior continuous surfaces;

support means projecting inwardly from said interior surface for assembling said cover member on said frame member, said support means including first and second channel-defining members projecting inwardly and extending along said interior surface for defining a channel configured to receive said predetermined perimeter of said frame member, said first and second channel-defining members being transversely spaced from one another longitudinally along said interior surface of said cover member, each of said channel-defining members projecting inwardly of said interior surface beyond said predetermined perimeter of said frame member received in said channel;

wherein said channel has an opening facing inwardly of said cover member, said opening having a width dimension extending longitudinally of said interior surface and transversely of said channel, said width dimension being at least as great as said known thickness of said frame member;

wherein said second channel-defining member is disposed below said first channel-defining member along said cover member assembled on said frame member;

wherein said second channel-defining member is temporarily distortable during assembly of said cover member on said frame member to permit insertion of said predetermined perimeter into said channel;

wherein said support means is disposed proximate said upper edge of said cover member;

and further comprising:

rigidifying means, structurally independent of said frame member and said lamp assembly, for simultaneously rigidifying said lower edge of said cover member while radially expanding said lower edge of force radial contraction of said interior surface proximate said upper edge and about said frame member, said rigidifying means being secured to said cover member proximate said lower edge;

wherein said rigidifying means comprises sleeve means secured to and extending circumferentially along said cover member and having an opening therein, and a length of wire-like material removably disposed within and along the entirety of said sleeve means, said wire-like material being selectively longitudinally insertable into and removable from said sleeve means via said opening.

16. A collapsible lamp shade capable of being folded or rolled for storage or shipping and removably supported on a lamp assembly by a shade frame member having a predetermined perimeter configuration and a known thickness, said lamp shade comprising:

a cover member of flexible material having a peripherally continuous configuration with first and second longitudinally spaced open ends defined by respective upper and lower continuous edges of said material, said cover member having interior and exterior continuous surfaces;

support means projecting inwardly from said interior surface for assembling said cover member on said frame member, said support means including first and second channel-defining members projecting inwardly and extending along said interior surface for defining a channel configured to receive said predetermined perimeter of said frame member, said first and second channeldefining members being transversely spaced from one another longitudinally along said interior surface of said cover member, each of said channel-defining members projecting inwardly of said interior surface beyond said predetermined perimeter of said frame member received in said channel;

wherein said channel has an opening facing inwardly of said cover member, said opening having a width dimension extending longitudinally of said interior surface and transversely of said channel, said width dimension being at least as great as said kknown thickness of said frame member;

wherein said second channel-defining member is disposed below said first channel-defining member along said cover member assembled on said frame member;

wherein said second channel-defining member is temporarily distortable during assembly of said cover member on said frame member to permit insertion of said predetermined perimeter into said channel; and rigidifying means, structurally independent of said frame member and said lamp assembly, for simultaneously rigidifying said lower edge of said cover member while expanding said lower edge to force contraction of said interior surface proximate said upper edge and about said frame member, said rigidifying means being secured to said cover member proximate said lower edge;

wherein said rigidifying means comprises sleeve means secured to and extending circumferentially along said cover member and having an opening therein, and a length of wire-like material removably disposed within and along the entirety of said sleeve means, said wire-like material being selectively longitudinally insertable into and removable from said sleeve means via said opening, said wire-like material being pre-stressed into arcuate form with a radius of curvature at least as large as the radius of said circumferential sleeve means.

17. A collapsible lamp shade capable of being folded or rolled for storage or shipping and removably supported on a lamp assembly by a shade frame member having a predetermined perimeter configuration and a known thickness, said lamp shade comprising:

a cover member of flexible material having a peripherally continuous configuration with first and second longitudinally spaced open ends defined by respective upper and lower continuous edges of said material, said cover member having interior and exterior continuous surfaces;

support means projecting inwardly from said interior surface for assemblying said cover member on said frame member, said support means including first and second channel-defining members projecting inwardly and extending along said interior surface for defining a channel configured to receive said predetermined perimeter of said frame member, said first and second channeldefining members being transversely spaced from one another longitudinally along said interior surface of said cover member, each of said channel-defining members projecting inwardly of said interior surface beyond said predetermined perimeter of said frame member received in said channel;

wherein said channel has an opening facing inwardly of said cover member, said opening having a width dimension extending longitudinally of said interior surface and transversely of said channel, said width dimension being at least as great as said known thickness of said frame member;

wherein said second channel-defining member is disposed below said first channel-defining member along said cover member assembled on said frame member;

wherein said second channel-defining member is temporarily distortable during assembly of said cover member on said frame member to permit insertion of said predetermined perimeter into said channel; and sleeve means secured to and extending circumferentially along said cover member proximate said lower edge and having an opening tehrein to permit access into said sleeve means, and a length of wire-like material removably disposed within and along the entirety of said sleeve means, said wire-like material being selectively insertable into and removable from said sleeve means via said opening.

18. The lamp shade according to claim 17 wherein said wire-like material is pre-stressed into an arcuate configuration with a radius of curvature larger than the radius of said circumferentially extending sleeve means.

19. The lamp shade according to claim 18 wherein said length of wire-like material is slightly greater than the circumferentially length of said sleeve means.

20. the lamp shade according to claim 19 wherein said sleeve means is secured to said exterior surface of said cover member and constitute a strip of decorative trim material for said lamp shade.

21. The lamp shade according to claim 19 wherein said sleeve means is secured to said interior surface of said cover member.

22. The lamp shade according to claim 17 wherein said length of wire-like material is slightly greater than the length of said sleeve means.

23. The lamp shade according to claim 17 wherein said support means is disposed proximate said upper edge of said cover member.

24. A collapsible lamp shade capable of being folded or rolled for storage or shipping and removably supported on a lamp assembly by a shade frame member having a substantially rigid frame ring of predetermined circumference with a known vertical thickness, said lamp shade comprising:

a cover member of flexible material having a peripherally continuous configuration with first and second open ends defined by respective upper and lower continuous edges of said material, said cover member having interior and exterior continuous surfaces;

support means projecting inwardly from said interior surface for assembling said cover member on said frame member, said support means including:

a strip of cloth material extending lengthwise in a substantially closed circumferential path along the interior surface of said cover member proximate said upper edge, said strip having first and second thickness layers between which upper and lower elongated sleeves are defined and transversely spaced from one another along said circumferential path; and first and second elongated members disposed within upper and lower sleeves, respectively, to project said sleeves inwardly from said interior surface beyond said predetermined circumference of said frame ring, said second elongated member being resiliently compressible in thickness to permit temporary distortion thereof during insertion of said frame ring between said upper and lower inwardly projecting sleeves.

25. The lamp shade according to claim 24 wherein said first and second elongated members are respective lengths of transversely compressible twine.

26. The lamp shade according to claim 24 wherein said frame ring is made of wire material having a substantially circular transverse cross-section with a predetermined diameter, and wherein the transverse spacing between said first and second elongated members is greater than said predetermined diameter.

27. The lamp shade according to claim 24 further comprising:

rigidifying means, structurally independent of said frame member and said lamp assembly, for simultaneously rigidifying said lower edge of said cover member while expanding said lower edge to force contraction of said interior surface proximate said upper edge and about said frame member, said rigidifying means being secured to said cover member proximate said lower edge.

28. The lamp shade according to claim 24 further comprising sleeve means secured to and extending circumferentially along said cover member proximate said lower edge and having an access opening therein to permit access into said sleeve means, and a length of wire-like material removably disposed within and along the entirety of said sleeve means, said wire-like material being selectively longitudinally insertable into and removable from said sleeve means via said access opening.

29. The lamp shade according to claim 28 wherein said wire-like material is prestressed into an arcuate configuration with a radius of curvature larger than the radius of said circumferentially extending sleeve means.

30. The lamp shade according to claim 29 wherein said length of wire-like material is slightly greater than the circumferential length of said sleeve means.

31. The lamp shade according to claim 28 wherein said sleeve means is secured to said exterior surface of said cover member and constitutes a strip of decorative trim material for said lamp shade.

32. The lamp shade according to claim 28 wherein said sleeve means is secured to said interior surface of said cover member.

33. A collapsible lamp shade capable of being folded or rolled for storage or shipping and removably supported on a lamp assembly by a shade frame member having a predetermined circumference, said lamp shade comprising:

a cover member of flexible material having a peripherally continuous configuration with first and second open ends defined by respective upper and lower continuous edges of said material, said cover member having interior and exterior continuous surfaces;

support means projecting inwardly from said interior surface for assembling said cover member on said frame member; and rigidifying means for preventing inadvertent collapse of said lower edge of said cover member when said cover member has been assembled on said frame member, said rigidifying means comprising: sleeve means secured to and extending circumferentially along said cover member proximate said lower edge and having an access opening therein to permit access to the inside of said sleeve means; and a length of wire-like material removably disposed within and extend along the entirety of said sleeve means, said wire-like material being selectively insertable longitudinally into and removable longitudinally from said sleeve means via said access opening.

34. The lamp shade according to claim 33 wherein the length of said wire-like material is slightly greater than the circumferential length of said sleeve means.

35. The lamp shade according to claim 33 wherein said sleeve means is secured to said exterior surface of said cover member and constitutes a strip of decorative trim material for said lamp shade.

36. The lamp shade according to claim 33 wherein said sleeve means is secured to said interior surface of said cover member.

37. The lamp shade according to claim 33 wherein said wire-like material is prestressed into an arcuate configuration with a radius of curvature larger than the radius of said circumferentially extending sleeve means.

38. The lamp shade according to claim 33 wherein said support means comprises:

upper and lower channel-defining members projecting inwardly from and extending along said interior surface to receive said predetermined circumference of said frame member, said upper and lower channel-defining members being transversely spaced from one another along said interior surface, each of said channel-defining members projecting inwardly of said interior surface beyond said predetermined circumference of said frame member received in said channel.

39. The lamp shade according to claim 38 wherein said channel has an opening facing inwardly of said cover member, said opening being everywhere at least as great transversely of the channel length as the vertical dimension of said frame member at said predetermined circumference.

40. The lamp shade according to claim 38 wherein said lower channel-defining member comprises an elongated member extending in a substantially continuous path along said interior surface, said elongated member being resiliently compressible in thickness to permit insertion of said predetermined circumference of said frame member into said channel.

41. The lamp shade according to claim 40 wherein said elongated member is a length of transversely and temporarily compressible twine.

42. The lamp shade according to claim 33 wherein said support means comprises:

a strip of cloth material extending lengthwise in a substantially closed circumferential path along said interior surface proximate said upper edge, said strip having first and second thickness layers between which upper and lower elongted sleeves are defined and transversely spaced from one another along said interior surface; and first and second elongated members disposed within said upper and lower sleeves, respectively, to project said sleeves inwardly from said interior surface beyond said predetermined circumference of said frame member, said second elongated member being resiliently compressible in thickness to permit temporary distortion thereof during insertion of said frame member between said upper and lower inwardly projecting sleeves.

43. The lamp shade according to claim 42 wherein said frame member is a ring made of wire material having a substantially circular transverse cross-section with a predetermined diameter, and wherein the transverse spacing between said first and second elongated members is greater than said predetermined diameter.

44. The lamp shade according to claim 33:

wherein said shade frame member includes a rigid outer ring of wire-like material having a generally circular cross-section;

wherein said predetermined circumference of said frame member is defined by the radial extremity of said outer ring;

wherein said shade frame member further includes:

an engagement member for engaging said lamp assembly at a location interiorly spaced from said interior surface of said cover member; and a plurality of angularly spaced struts extending between said engagement member and said ring securing said ring relative to said engagement member;

wherein said lamp assembly includes: a socket member having an upper receiving portion space surrounded by said interior surface; and a harp member having two spring arms joined at a vertex for resilient mutual angular contraction, said arms, each having a distal end, said harp member including a stud extending from said vertex in a direction substantially opposite said spring arms;

wherein said engagement member comprises means secured to said assembly for engaging said distal ends of said spring arm on opposite sides respectively of said socket member;

wherein said frame member includes an inner ring adapted to receive said stud member to thereby engage said frame member on said lamp assembly, said inner and outer rings being disposed substantially co-planar;

wherein said engagement means further comprises an adapter having an annular portion adapted to be secured to and disposed about said socket member, and first and second receptacles secured to opposite sides of said annular portion for receiving the distal ends of said first and second spring arms, respectively, the spacing between said first and second receptacles being less than the spacing between the distal ends of said first and second spring arms when said spring arms are unstressed, wherein said annular portion has an inside diameter greater than the uppermost portion of said socket member to permit said adapter to be assembled on said socket member from above when said light source is removed from said socket member.

45. A lamp shade capable of being folded or rolled for storage or shipping and removably supported on a lamp assembly, said lamp shade comprising:

a cover member of flexible material having a peripherally continuous configuration with first and second open ends defined by respective upper and lower continuous edges of said material, said cover material having interior and exterior continuous surfaces, said lower edge having a greater perimetral length than said upper edge;

frame means secured to said lamp assembly for mounting said cover member on said lamp assembly;

engagement means disposed on said interior surface of said cover member for receiving said frame means and supporting said cover member on said frame means;

rigidifying means, structurally independent of said frame means and said lamp assembly, for simultaneously rigidifying said lower edge to said cover member and expanding said lower edge to force contraction of said interior surface proximate said upper edge about said frame means, said rigidifyig means being secured to said cover member proximate said lower edge;

wherein said cover member, when mounted on said lamp assembly, is generally frustoconical and said upper and lower edges are substantially annular, and wherein said rigidifying means comprises:

sleeve means secured to said cover member proximate and extending substantially along the entire cover member in a generally circular path having a known radius and circumference, said sleeve means having an access opening; and wire means of specified length for selective lengthwise insertion into and removal from said sleeve means via said access opening, said wire means having an arcuate bias position with a radius of curvature greater than the radius of said circular path.

46. The lamp shade according to claim 45 wherein said specified length is greater than the circumference of said circular path.

47. The lamp shade according to claim 45 wherein said frame means includes a substantially rigid hoop, and wherein said engagement means includes upper and lower channel-defining members projecting inwardly from said interior surface of said cover member to define a hoop-receiving channel in which, each of said channel-defining members project radially inward beyond the periphery of said hoop.

48. The lamp shade according to claim 47 wherein said upper and lower channel-defining members comprise upper and lower resiliently and transversely compressible ribs extending substantially entirely along said interior surface in transversely spaced relation proximate said upper edge.

49. The lamp shade according to claim 47 further comprising:

an elongated strip of cloth material secured to said interior surface and extending along said circular path, said strip of cloth having first and second longitudinally extending and transversely spaced sleeves defined therein;

wherein said upper and lower ribs include first and second lengths of resiliently and transversely compressible material disposed in and extending substantially entirely through said first and second sleeves, respectively.

50. The lamp shade according to claim 49 wherein said resiliently and transversely compressible material is twine.

51. The lamp shade according to claim 45 wherein said sleeve means is secured to said interior surface of said cover member.

52. The lamp shade according to claim 45 wherein said length of wire-like material is sligthly greater than the length of said sleeve means.

* * * * *